US005524849A

United States Patent [19]

Dörfel et al.

[11] Patent Number: 5,524,849

[45] Date of Patent: Jun. 11, 1996

[54] CLAMPING HEAD FOR WINDING TUBES

[75] Inventors: Gerhard W. Dörfel, Boll; Jürgen Treutner, Ostfildern, both of Germany

[73] Assignee: Beloit Technologies, Inc., Wilmington, Del.

[21] Appl. No.: 293,523

[22] Filed: Aug. 19, 1994

Related U.S. Application Data

[63] Continuation of Ser. No. 952,877, filed as PCT/EP90/00980, Jun. 21, 1990., abandoned.

[30] Foreign Application Priority Data

May 23, 1990 [DE] Germany ..... 40 17 007.1

[51] Int. Cl.[6] ..... B65H 75/24

[52] U.S. Cl. ..... 242/571.6

[58] Field of Search ..... 242/72.1, 68.2, 242/68.3, 571.6, 571.7

[56] References Cited

U.S. PATENT DOCUMENTS

| | | | |
|---|---|---|---|
| 3,881,666 | 5/1975 | Greenhalgn | 242/72.1 X |
| 3,997,176 | 12/1976 | Wyckoff et al. | 242/72.1 X |
| 4,148,444 | 4/1979 | Hehner | 242/72.1 X |
| 4,244,534 | 1/1981 | Rennbaum et al. | 242/72.1 |
| 4,284,251 | 8/1981 | Castillo | 242/72.1 X |
| 4,715,551 | 12/1987 | Besemann | 242/72.1 X |

FOREIGN PATENT DOCUMENTS

| | | |
|---|---|---|
| 1574438 | 10/1971 | Germany . |
| 2910114 | 9/1980 | Germany . |
| 2815310 | 6/1982 | Germany . |
| 3700472 | 7/1988 | Germany . |

*Primary Examiner*—Daniel P. Stodola
*Assistant Examiner*—Eileen A. Dunn
*Attorney, Agent, or Firm*—Dirk J. Veneman; Raymond W. Campbell; erald A. Mathews

[57] ABSTRACT

A clamping head for engaging the interior cavity of a hollow tube, or core, used to wind a traveling web, such as paper produced by a papermaking machine, comprises a head shank in the shape of a truncated hexahedral pyramid having a clamping surface on each side of the hexahedron. A corresponding number of clamping pieces have contact surfaces which engage the clamping surfaces. The clamping and contact surfaces are contoured with concave, convex and straight pitches in the circumferential direction relative to the shank such that their contact is substantially linear. Expansion of the clamping pieces to engage the core is provided by a combination of pivotal and sliding movement of the contact surfaces on the clamping surfaces.

6 Claims, 6 Drawing Sheets

CLAMPING HEAD FOR WINDING TUBES

This is a continuation of application Ser. No. 07/952,877, filed as PCT/EP90/00980, Jun. 21, 1990, now abandoned.

BACKGROUND OF THE INVENTION

1. Field of the Invention

The invention relates to a clamping head for winding tubes. More particularly, this invention relates to a clamping head which utilizes both an axially movable slide block and a pivotally movable thrust member to provide uniform expansion and contraction action relative to the inner surface of a tube or core, such as is used in the papermaking industry to begin formation of wound rolls of paper or board.

2. Description of the Prior Art

Such a clamping head, which is sometimes called a core chuck in the papermaking industry, is known from German patent publication DE 1 574 438 B. It is used for winding material in web form, such as paper webs and the like, onto winding tubes, and also for winding off from such winding tubes. A clamping head is selectively engageable with each tube end, in a central, essentially circular recess, in order to transmit the torque necessary for winding-on or controlled winding-off to or from the winding tube. In the papermaking industry, such tubes are sometimes called cores or reel spools.

In the case of the above-referenced known clamping head, a hexagonal clamping head shank is provided that is encompassed by clamping pieces in the form of segments. The radial inner surfaces (contact surfaces) of the clamping pieces abut, in planar fashion, the six outer surfaces of the clamping head shank while in their non-expanded, resting position where they do not engage the tube. The radial outer surfaces of the clamping pieces, which are subsequently made to fit in the recess of the winding tubes, form, in the resting position, a periphery that is normally less than the overall circumferential length of the recess at the end of the winding tube. The clamping pieces and the clamping head shank can be rotated relative to one another. In this way, the clamping pieces can be pressed in a radially outward direction along their overall length looking to the axial direction of the clamping head, so that their outer surfaces spread non-positively in the recess of the winding tube. As the web is wound-on progressively, the roll diameter, and thus the torque to be transmitted, increases. This automatically leads to an increased expansion of the clamping pieces. However, it is not necessarily possible, upon completion of the winding-on or winding-off process, to muster the same maximum torque between the tube, or the roll, and the clamping head in the opposite direction as had occurred during the winding process in the original direction. It is not possible, therefore, to loosen or to readjust the expander. The clamping heads must therefore be withdrawn axially from the winding tube in their expanded operating position using great force.

Drawing the winding tubes off the clamping head using a different clamping head design, as described inter alia in German patent publication DE 28 15 310 C, is easier than utilizing the clamping heads of the type previously mentioned because with this other known clamping head design, instead of torsion, there is an axial movement between the clamping head shank and the clamping pieces in order to achieve expansion or contraction of the clamping pieces. For this purpose, the sliding surfaces between the clamping head shank and the clamping head pieces are wedge-shaped. An axial stop connected to the clamping pieces, which axial stop abuts the tube face when the clamping pieces are not yet expanded, enables a force in the axial direction to be transmitted through which the clamping pieces slide along the clamping head shank and so expand in the recess at the winding tube end. In doing so, the expansion distance that is constant along the whole of the clamping length depends on the magnitude of the sliding-in force applied in the axial direction. When the clamping head is axially withdrawn from the winding tube, the clamping head shank initially retracts relative to the clamping pieces, and the clamping pieces move in a radially inward direction. As a result, the radial force of pressure abates. With this clamping head design, it is easier, therefore, to withdraw the clamping head from the winding tube than it is with the prior-art type clamping heads previously mentioned. However, along with this advantage goes, inter alia, the disadvantage that the clamping force depends exclusively on the axial force exerted on the clamping heads. If this is excessive, the winding tubes become distorted; if it is not sufficient, then as the torque increases, there is the danger of slippage between winding tube and clamping head. Neither is desirable.

The relative position between the clamping pieces, and therefore the winding tube as well, and the clamping head shank is necessarily variable and undefined in the case of clamping heads of this second prior-art design. Generally speaking, however, this is not desirable.

SUMMARY OF THE INVENTION

In order to ensure that the expansion distance of the clamping pieces is constant along the whole of their effective length, the clamping head of this invention, the lateral surfaces of the clamping head shank, or the contact surfaces of the clamping pieces, or both, are curved in the direction of the clamping head periphery. The extent of curvature in the longitudinal direction essentially changes progressively so that rotation between the clamping head shank and the clamping pieces leads to an identically long expansion and contraction path along the whole length of the clamping pieces in the longitudinal (axial) direction.

Although, in practice it is not really essential for the relative position, looking in the axial direction, between the clamping head shank and the clamping pieces to be always the same, it does matter that the expansion distance along the whole of the effective length of the clamping pieces is constant.

The constancy of the expansion distance along the effective length of the clamping pieces is achieved in a particularly simple way.

A comparatively low friction resistance between the clamping head shank and the clamping pieces during expansion or contraction is achieved by a partial rolling line contact between the clamping head shank and the individual clamping pieces. Furthermore, especially precisely definable relative positions between the clamping head shank and the clamping pieces are achieved in this way. However, in addition to the rolling-off movement between the clamping pieces and the clamping head shank, a certain sliding movement can also take place. The rolling-off movement is achieved in a particularly simple fashion by making the contact surfaces of the clamping pieces cylindrical.

In order to achieve an automatic readjustment of the rotating movement between the clamping head shank and the clamping pieces after the withdrawal of a clamping head from a winding tube, the clamping head can be equipped with a spring between the clamping pieces and the clamping head shank. This spring is put under tension upon rotation of the head shank relative to the clamping pieces. The spring then restores rotation of these elements after withdrawal of the clamping head from the winding tube. Other embodiments of this solution, which can be used to advantage in the case of generic clamping heads, can utilize a flat spiral spring extending peripherally about the clamping head. Also, a spring can be supported in the clamping head housing to be rotated and also slid together with the clamping pieces relative to the clamping head shank on a stop fixed to the housing or on a carrier fixed to the clamping head shank.

An object of this invention is, therefore, to create a clamping head which facilitates withdrawal of the clamping head from the winding tube while maintaining a condition of torque-dependent expansion.

A clamping head, according to this invention, has, among other things, the advantage that the radial expansion distance is torque-dependent, so that both damage to the winding tubes, as well as slippage of the winding tubes is avoided while still facilitating withdrawal of the clamping head from the winding tube. The advantages of the two prior-art types of clamping head designs previously mentioned are, therefore, combined without the disadvantages.

In the clamping head of this invention, another advantage is that the relative position between the winding tube and the clamping head shank is always precisely defined in the axial direction because the expansion distance is always composed of a sliding-related and a rotation-related part, with the sliding-related part always automatically having precedence because the clamping head must necessarily be inserted initially in its axial direction before rotation can begin.

Further details, features and advantages of the object of the invention will emerge from the following description of the relevant drawing, in which, by way of example, a preferred specific embodiment of a clamping head, as per the invention, is represented.

DESCRIPTION OF THE PREFERRED EMBODIMENTS

A clamping head, shown in the Figures as 100, for winding tubes 10 comprises a clamping head shank 20, a tube-shaped part serving as a clamping head housing 30, as well as clamping pieces 40.

Figure 1A:
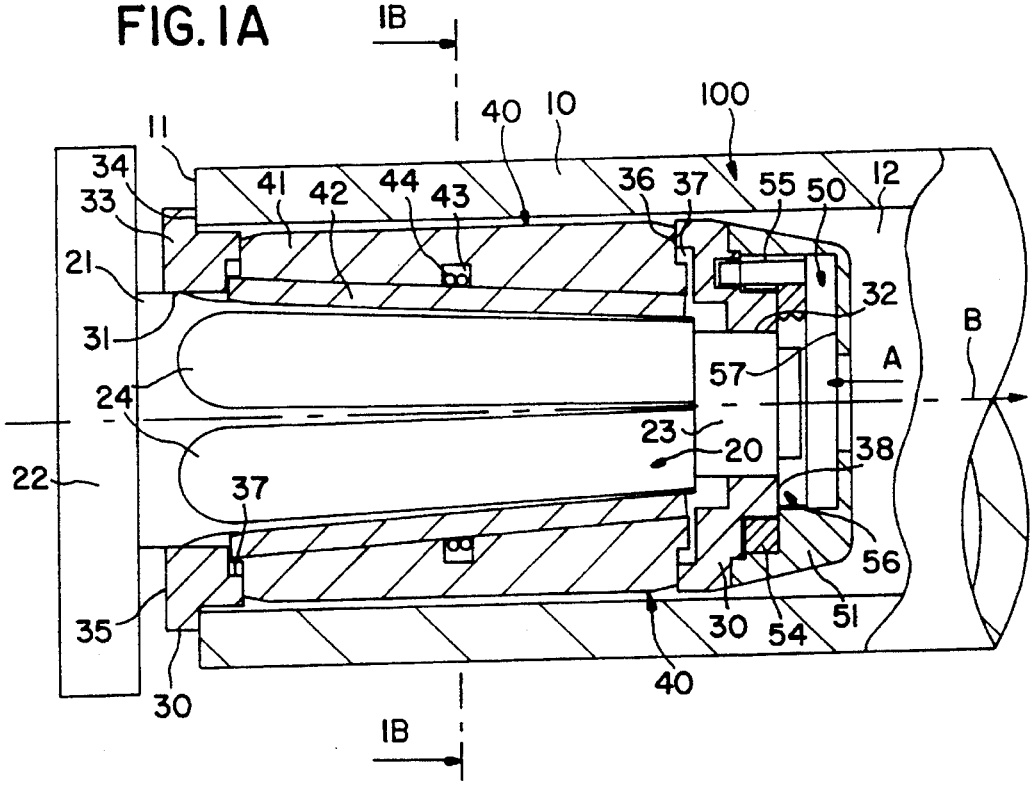
FIG. 1*a* is a side-elevational view of the clamping head of this invention, partially in section, in retracted position within a winder tube. The section is along Ia—Ia shown in FIG. 1*b*.
Figure 1B:
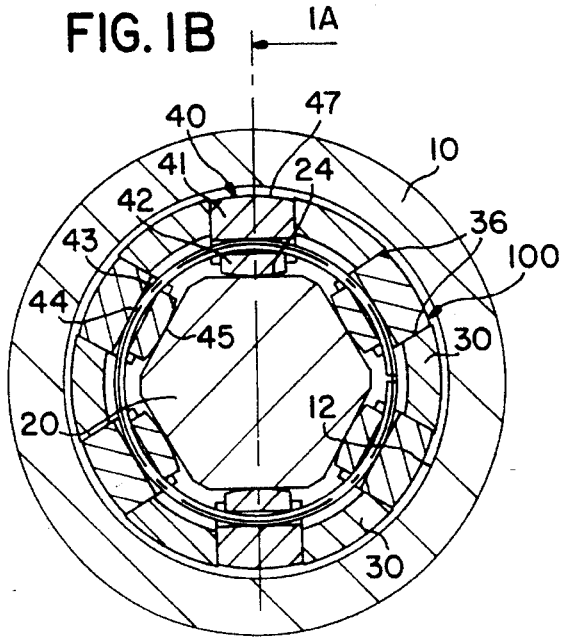
FIG. 1*b* is a front end view, along section Ib—Ib in FIG. 1*a*, of the clamping head of this invention.

The winding tubes 10 shown in the Figures comprise, as can be seen in FIGS. 1*a* and 1*b*, circular cylindrical pipes with face ends 11 and a concentric recess 12 accessible from the front side, into which recess the clamping head 100 can be pushed in an axial direction. Pipe-shaped winding tubes are the most frequently used, but it is also possible to use internally-closed circular cylindrical bodies with corresponding recesses in the face ends as winding tubes.

The clamping head shank 20 takes the form of a hexahedral, truncated pyramid, whose base 21 is secured to a plate 22. The plate 22, or the clamping head shank 20 itself, is rotatably supported in known fashion on support arms and can, if necessary, be driven in the direction of rotation around the axial direction B, as shown in FIG. 1*a*. The clamping head shank takes the form of a cantilever shaft, i.e. supported on one side. With reference to its base 21 and its free end 23, the clamping head housing 30 is rotatably supported. Furthermore, a readjusting device 50, to be described later, is secured to its free end.

Figure 1C:
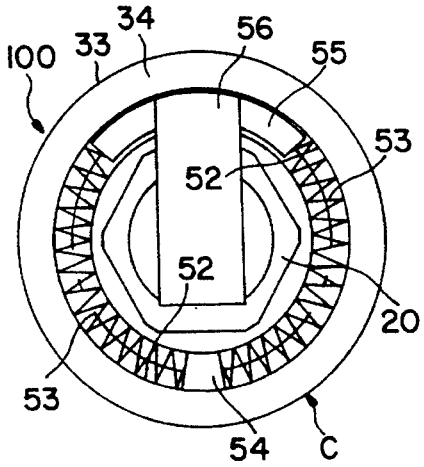
FIG. 1*c* is a front end view of the clamping head shown in FIG. 1*a*, in the direction of arrow A shown in FIG. 1*a*, but without the cover.

The six clamping surfaces 24 of the clamping head shank 20 are slightly inclined towards axial direction B (FIG. 1*a*) and shaped in a straight line in the direction of extension corresponding to the axial direction. In contrast, the clamping surfaces 24 in direction C of the clamping head periphery (see FIG. 1*c*) are concavely curved, this concave curvature being at its most pronounced at the narrow end, or free end 23, of the truncated pyramid and decreasing progressively to zero towards base 21. This emerges particularly clearly from FIG. 5.

The six clamping pieces 40 distributed uniformly along the periphery consist of thrust members 41 and sliding blocks 42 that are connected to one another in a generally known fashion. Inner surfaces 48 of each thrust member 41 is in opposed array, and is in contact, with corresponding outer surfaces 49 of the sliding blocks 42, as shown in FIG. 1*a*. Springs 44 are carried through an opening 43 in each clamping piece 40 in the peripheral direction, which springs, as can be seen in FIG. 1*b*, take the form of open rings and serve as readjusting springs acting in the direction of contraction. The sliding blocks 42 are, as can be seen in FIG. 1*a*, shaped in a straight line in the axial direction and are, as can be seen from FIGS. 5 and 6, convexly curved in the transverse expansion (peripheral direction 13), so that their contact surface 45, with which they abut the allocated (i.e. corresponding) clamping surface 24 of the clamping head shank 20, is circular cylindrical in shape. The respective contact between the clamping piece and the clamping head shank is, therefore, effected along a contact line 46, shown in FIGS. 5 and 6, regardless of the size of the twisting angle between clamping head shank and clamping piece.

On the base end of the clamping head shank, the clamping head housing 30 has a cylindrical sliding surface 31 and a cylindrical sliding surface 32 at the free clamping head end. At the base end, a stop 33 that projects like a flange is connected in one piece with the clamping head housing or is secured to it. It forms an initial end limit stop 34 for the front end 11 of the winding tube 10, as well as a second end limit stop 35 for the axial movement relative to the clamping head shank 20 which acts in conjunction with the plate 22, shown in FIG. 2a. The clamping head housing 30 is provided with elongated openings 36 within which the clamping pieces 40 are held and arranged so that they can be slid in a radial direction. End limit stops 37 delimit the maximum possible expansion distance of the clamping pieces 40.

The readjusting device 50 is located in a conically tapering cover 51 that is connected so that it cannot turn with the clamping head housing 30 by means of screws, which are not shown in the drawing. Inside the cover 51, an annular, or ring, segment shaped groove 52 in which two flat spiral springs 53, a stop 54 connected to the cover, i.e. to the housing, as well as a carrier 55 in the shape of a ring segment are located. The carrier 55 is secured so that it cannot turn to the free face end of the clamping head shank 20 by an arm 56 connected to the carrier. The carrier 55 and the arm 56 are shaped such that they can be rotated together inside the cover 51, as well as in relation to the clamping head housing 30 against the restoring action of the springs 53. The springs 53 maintain the clamping head housing 30 and the clamping head shank 20 in a neutral torsional position relative to one another, while the clamping head is outside the winding tube or while the rotation between clamping head shank and clamping head housing has not yet been effected, as is the case in the operating positions according to FIGS. 1 and 2. Upon completion of rotation, one of the springs 53 is under tension and the other spring 53 relaxed or under tension in the opposite direction. This can be seen in FIGS. 3*c* and 4*c*. The energy now stored in the compressed or expanded springs is only released again once the winding tube is drawn off the clamping head.

Figure 2A:
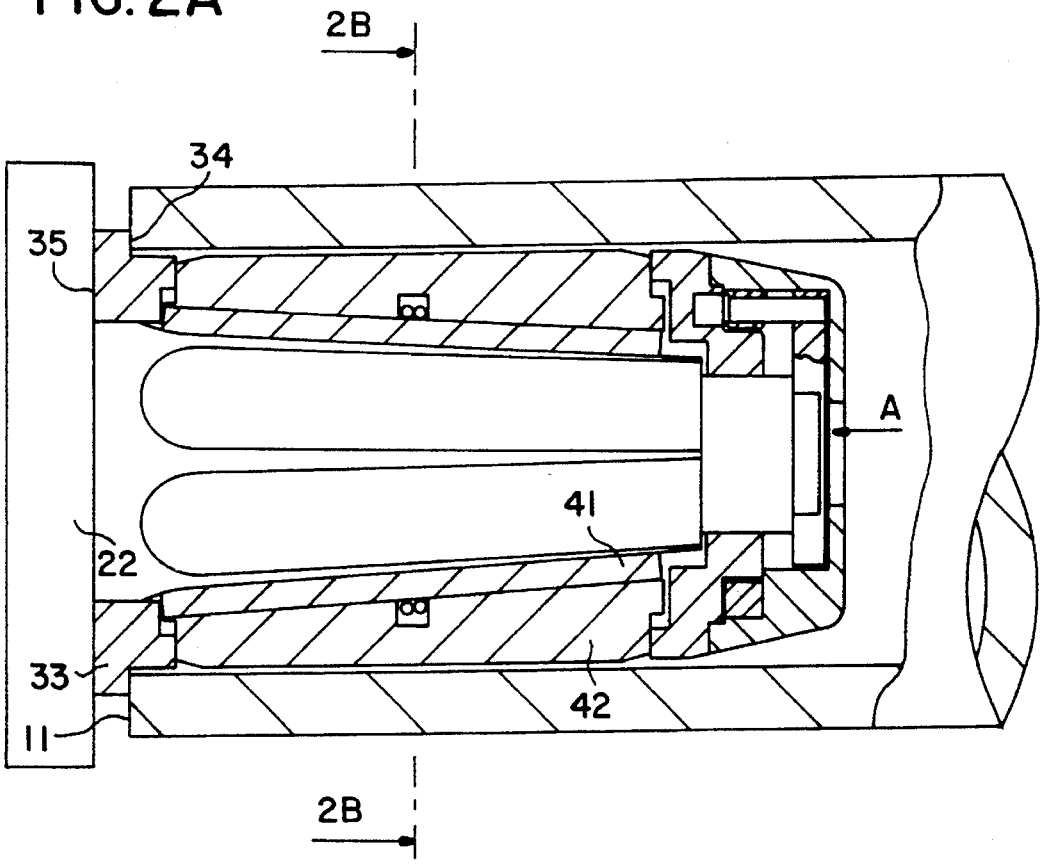
FIG. 2*a* is a sectional view, similar to FIG. 1*a*, of the clamping head, taken through section IIa—IIa in FIG. 2*b*, upon completion of the axial clamping distance movement dependent upon the axial sliding movement.
Figure 2B:
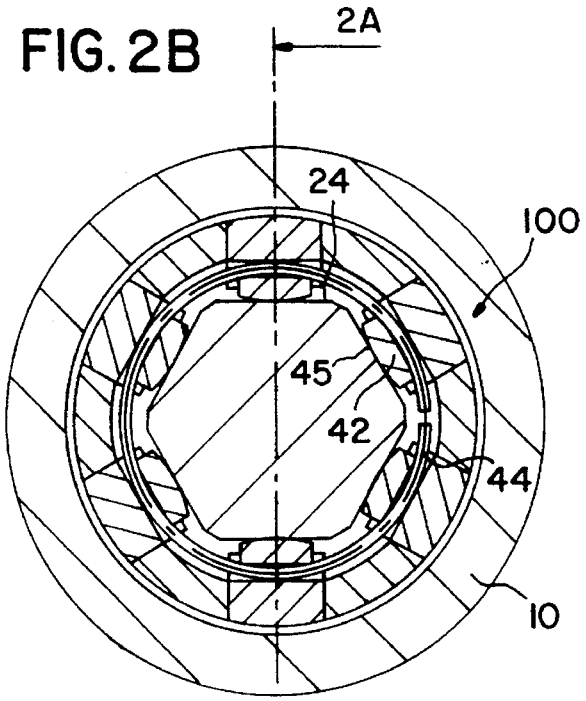
FIG. 2*b* is a sectional view, similar to FIG. 1*b*, of the clamping head, taken through section IIb—IIb in FIG. 2*a* and showing the clamping head in operating position.
Figure 2C:
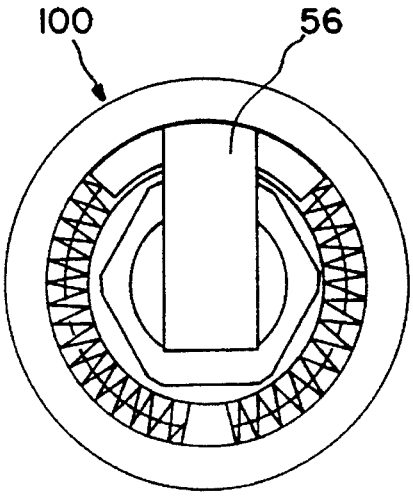
FIG. 2*c* is a front end view of the clamping head shown in FIG. 2*a*, but without the cover.
Figure 3A:
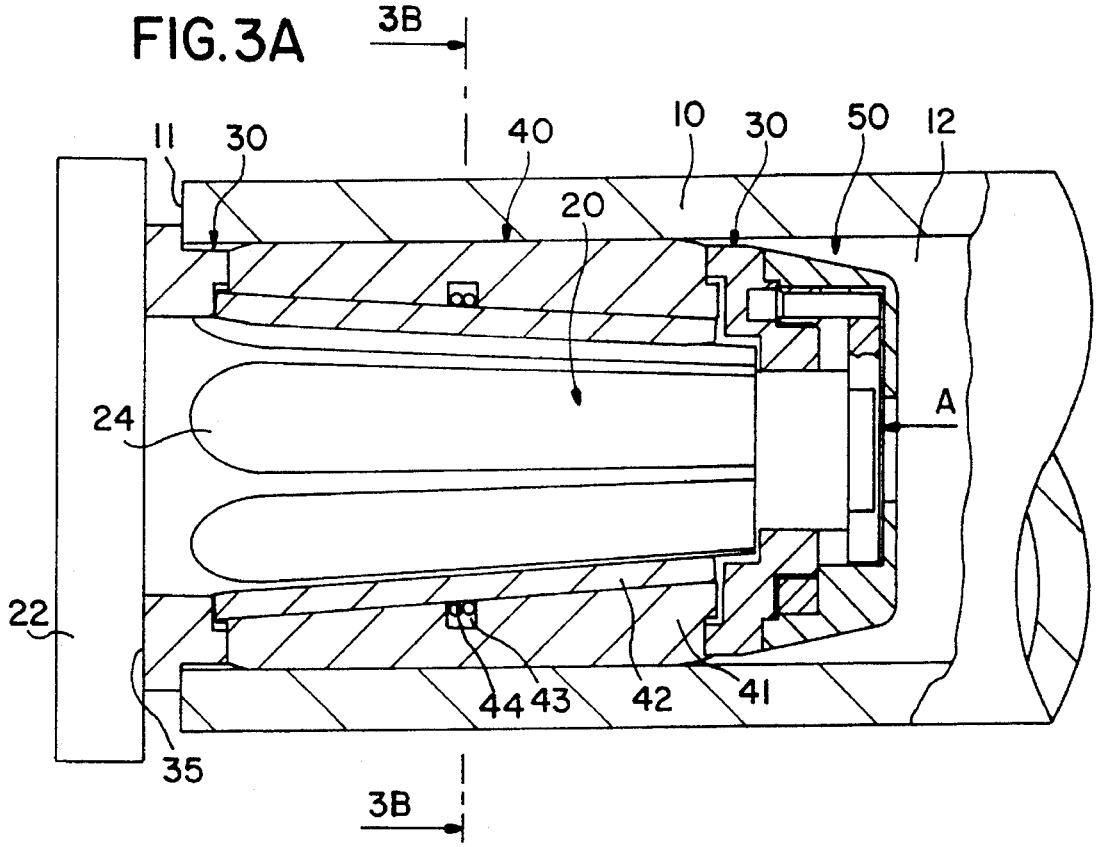
FIG. 3*a* is a sectional view, similar to FIGS. 1*a* and 1*b*, of the clamping head, taken through section IIIa—IIIa in FIG. 3*b*, but in a third operating position with the clamping pieces firmly expanded in the interior of the winding tube.
Figure 3B:
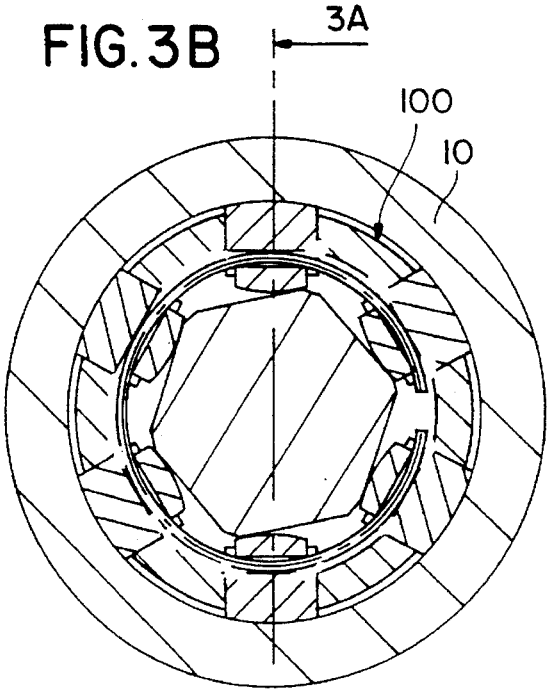
FIG. 3*b* is a sectional view, similar to FIGS. 1*b* and 2*b*, of the clamping head, taken through section IIIb—IIIb in FIG. 3*a*.
Figure 3C:
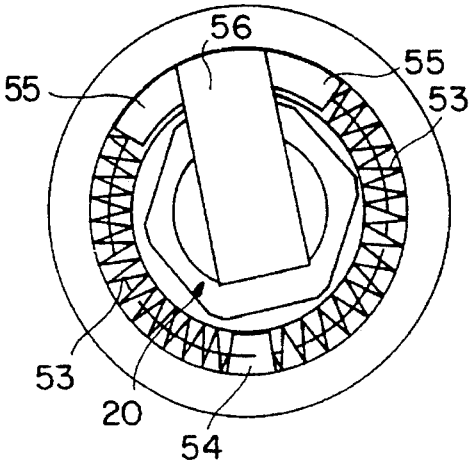
FIG. 3*c* is a front end view of the clamping head shown in FIG. 3*a*, but without the cover.

By comparing FIGS. 1*a* and 2*a*, it can be seen that the maximum possible sliding distance in axial direction B between the clamping head shank 20 and the clamping head housing 30 is relatively small and limited on the one hand by way of the carrier arm 56 through the inner surface 57 of the cover 51 and the front face 38 of the clamping head housing 30 on the other hand. In conjunction with the only slight tapering of the clamping surfaces 24 of the clamping head shank 20 relative to one another, this results in the sliding-related expansion distance of the clamping pieces 40 being relatively small. This can be seen easily by comparing FIGS. 1*a* and 2*a*. Generally speaking, it is not even necessary, if not possible, for the pressure surfaces 47 of the clamping pieces 40, which surfaces lie in a radially outward direction, to touch the inner wall surfaces of the winding tube 10 when the sliding-related expansion distance of the clamping pieces has been fully completed, as shown in FIG. 2*a*. In this operating position, there need only be an initial, but relatively low, friction-tightness between the winding tube 10 and the clamping head 100 for a rotation between the clamping head housing 30 and the clamping pieces 40 on the one hand, and the clamping head shank 20 on the other hand, to be possible when the clamping head is rotated against a tensile force acting on the winding tube periphery. With such a rotational movement, a combined sliding and rolling movement takes place between the clamping head shank 20 and the clamping pieces 40. This can be seen particularly clearly in FIGS. 5 and 6. In this way, the clamping pieces spread out in an outward radial direction and expand securely in the recess 12 of the winding tube 10, as shown in FIGS. 3*a*, 3*b* and 3*c*.

Figure 4A:
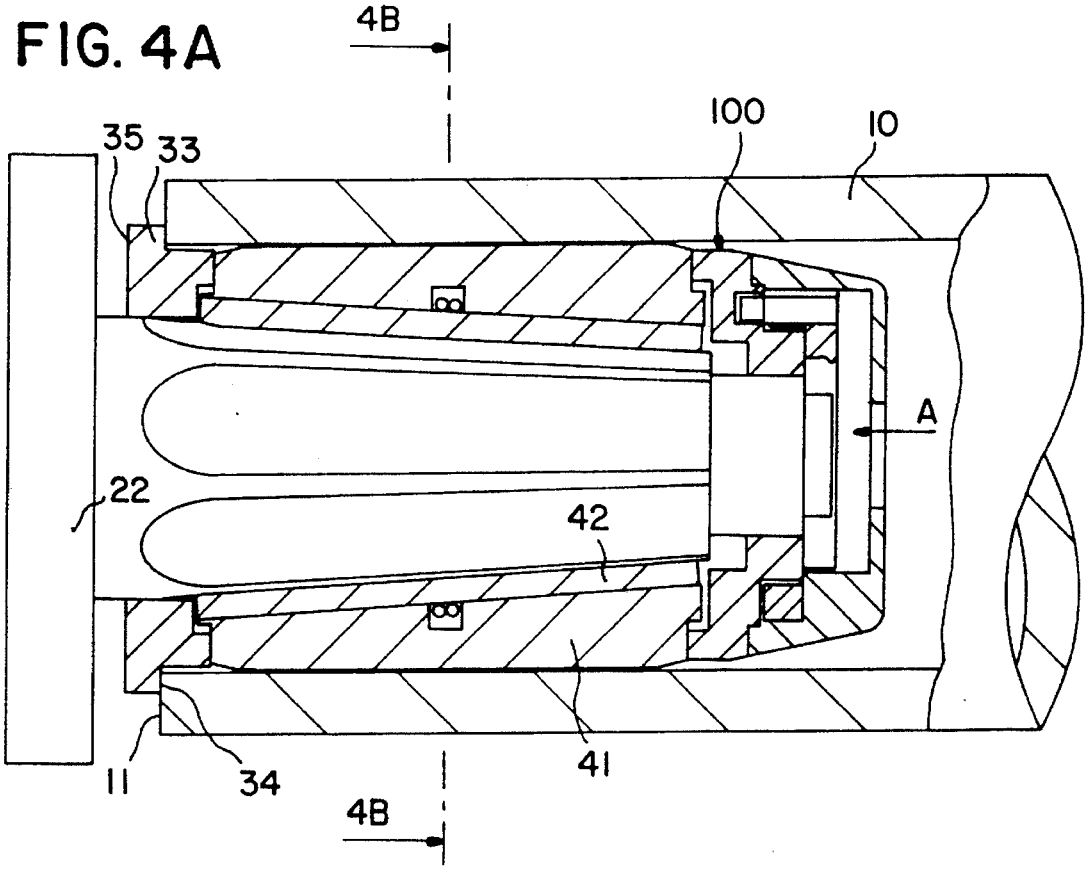
FIG. 4*a* is a sectional view, similar to FIGS. 1*a*, 2*a* and 3*a*, of the clamping head, taken through section IVa—IVa in FIG. 4*b*, but in a fourth operating position with the clamping pieces firmly expanded in the interior of the winding tube, the clamping head shank rotated relative to the slide blocks, and the shank retracted axially.
Figure 4B:
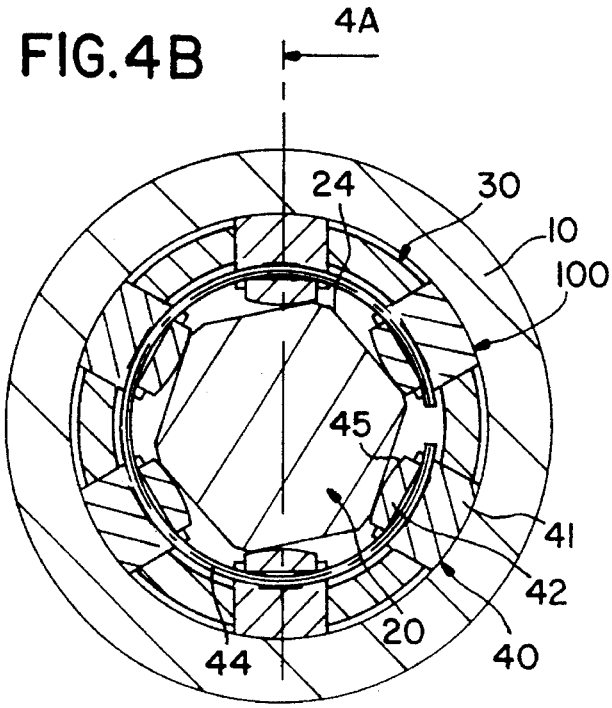
FIG. 4*b* is a sectional view, similar to FIGS. 1*b*, 2*b* and 3*b*, of the clamping head, taken through section IVb—IVb in FIG. 4*a*.
Figure 4C:
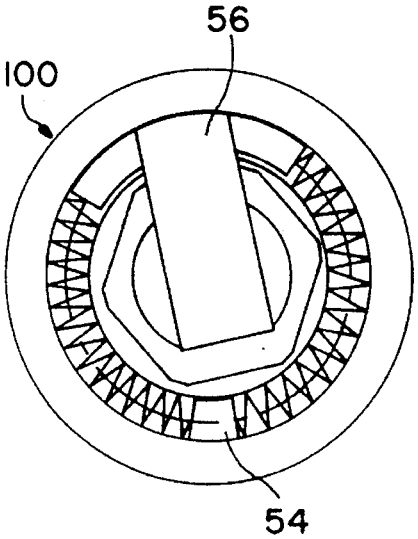
FIG. 4*c* is a front end view of the clamping head shown in FIG. 4*a*, but without the cover.

If the winding tube is again drawn off the clamping head (actually it might more accurately be stated that the clamping head is withdrawn from the tube), a force directed in an axially outward direction is exerted in known fashion on the clamping head. In this way, the clamping head shank 20 withdraws from the clamping head housing 30 around a small sliding piece. The sliding-related expansion distance of the clamping pieces is, therefore, reversed, aided by the readjusting springs 44. The relatively small contraction distance of the clamping pieces, already completed in the representation according to FIGS. 4a, 4*b* and 4c, is sufficient for the clamping head to be drawn out of the winding tube 10 using comparatively little force.

Figure 5:
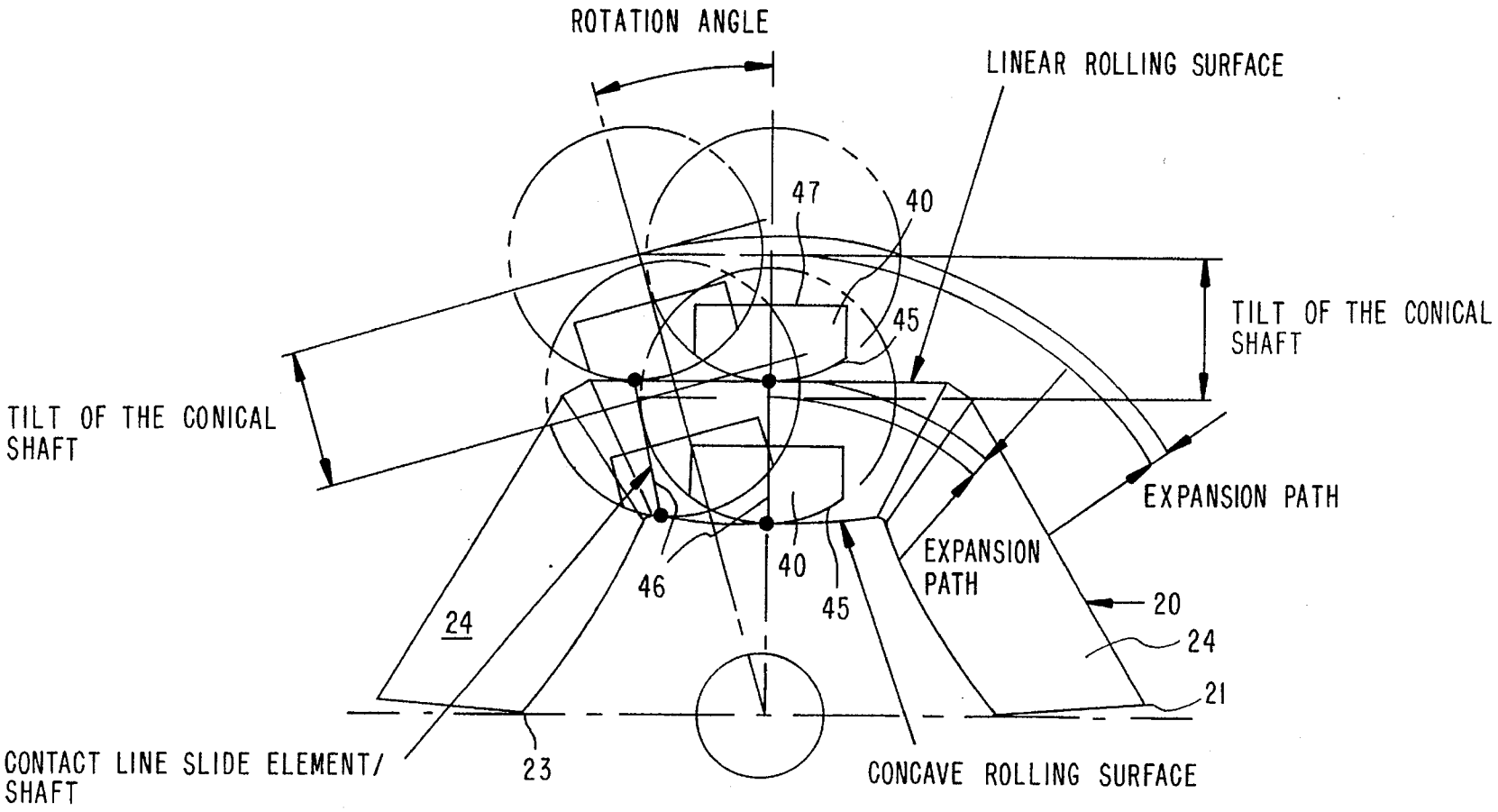
FIG. 5 is a schematic face view of the clamping head of this invention which shows the relative positions between the clamping head shank and the clamping piece with and without reciprocal rotation. The clamping surface at the large, secured end of the shank has a straight pitch, while the surface at the small, free end of the shank has a concave pitch.
Figure 6:
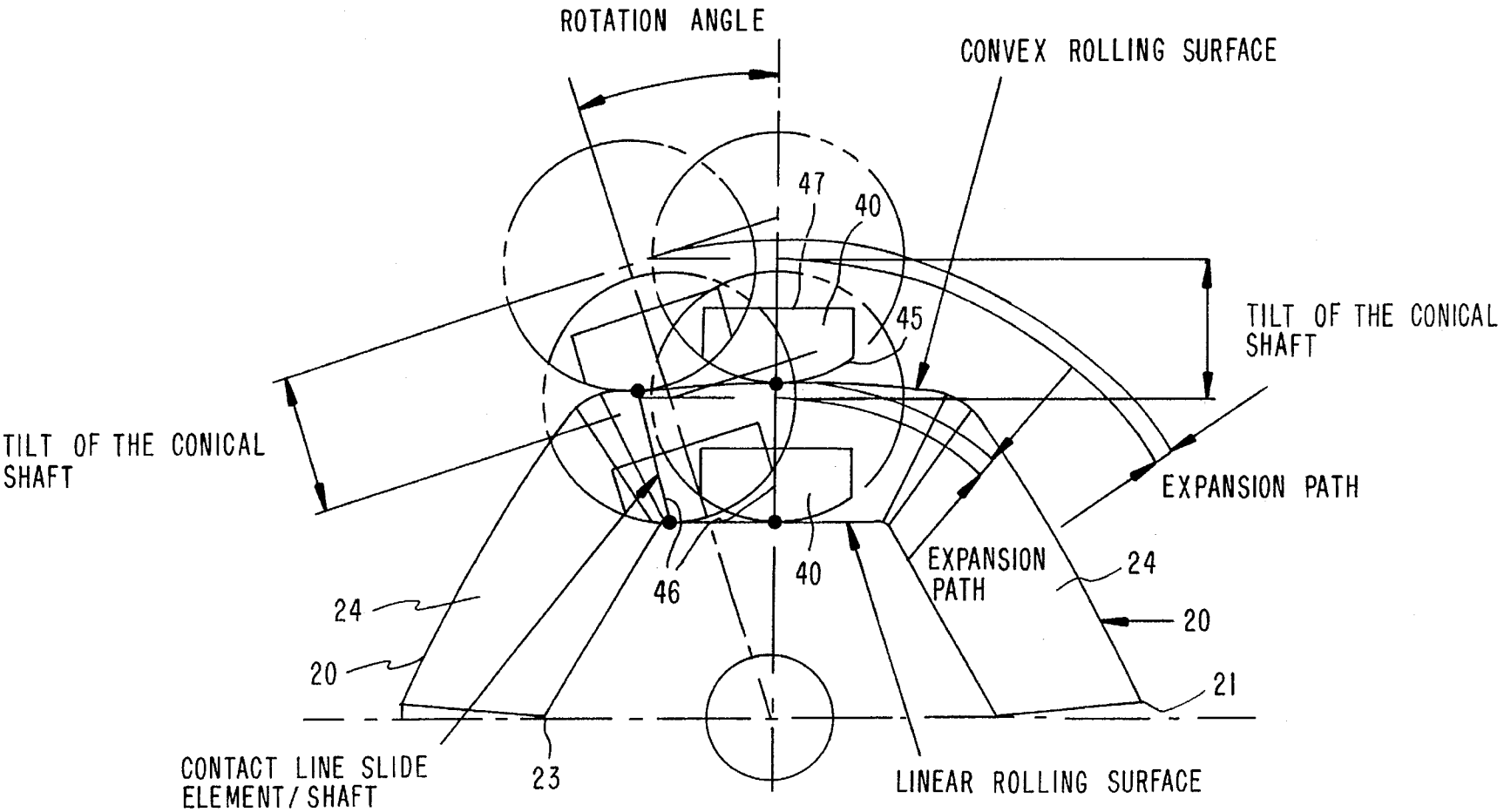
FIG. 6 is a schematic face view of an alternative specific embodiment of the shank of the clamping head of this invention. The clamping surface at the large, secured end of the shank has a convex pitch, while the surface at the small, free end has a straight pitch.

FIGS. 5 and 6 show that the expansion distance of the clamping pieces 40, or of the slide blocks 42, is identical at the front and rear end of the clamping pieces looking in the axial direction because the clamping surfaces 24 along the clamping head shank have a curvature that is constantly changing. Due to the gradual transition between maximum curvature and minimum curvature along the clamping head shank, the slide blocks 42 abut the clamping surfaces 24 along the full length of the shank. The pressure surfaces 47 of the clamping pieces 40, therefore, remain parallel to the axis in all expansion and contraction positions. The necessary curvature geometry can be calculated mathematically relatively simply. The same effect can also be achieved if the curvature, in particular the radius of curvature, of the contact surface 45 of the clamping pieces 42 changes continually along the length of the clamping piece 40, or if different curvatures are provided, both at the clamping head shank 20 and at the clamping pieces 40. The geometry shown in FIGS. 5 and 6, nevertheless, has the advantage that it can be mastered very easily.

The aforementioned structural elements to be used as per the invention are not subject to any specific exceptions as regarding their size, shape, selection of materials or technical design, so that known selection criteria can be applied without restriction in the respective field of application.

We claim:

1. A clamping head, having a longitudinal axis, for selectively engaging with, and disengaging from, a cylindrical cavity in the end of an elongated tube to rotate the tube about the longitudinal axis, comprising, in combination:

a plate;

a head shank mounted to the plate and having a plurality of clamping surfaces, the head shank extending outwardly from the plate, and concentric with the longitudinal axis, with the clamping surfaces extending longitudinally of the head shank at an angle to the longitudinal axis to form a larger end of the head shank, which larger end is mounted to the plate, and having a smaller, free end of the head shank for extending into the cylindrical cavity of the tube, the clamping surfaces forming a polygon in a plane perpendicular to the longitudinal axis;

clamping piece means disposed about the head shank for selectively expanding to produce pressure between the head shank and the cylindrical cavity in the tube, and contracting to relieve the pressure, the clamping piece means including a plurality of slide blocks and thrust members corresponding in number to the number of clamping surfaces, each slide block having an inner contact surface and an outer surface, the inner contact surface disposed over a corresponding clamping surface for slidably engaging the clamping surface, and each thrust member having proximal and distal ends relative to the plate, and including an inner contact surface for engaging the outer surface of a corresponding slide block, and each thrust member further including a pressure surface for engaging the tube cavity;

the corresponding clamping surfaces having different curvatures extending in the circumferential direction about the head shank with each such different curvature as would be described in a separate one of a plurality of imaginary planes disposed perpendicular to the longitudinal axis and spaced along the longitudinal axis such that the contour of the clamping surfaces changes gradually and smoothly as they extend longitudinally in the longitudinal axial direction of the clamping head, the corresponding clamping surfaces of the head shank and contact surfaces of the slide blocks being so shaped and arranged as to provide substantially line contact between the said clamping and contact surfaces in the longitudinal direction;

stop means disposed about the head shank near the larger end engaging the thrust members and for engaging the tube upon insertion of the clamping head into the cylindrical cavity;

end limit stop means for delimiting the maximum axial movement of the clamping piece means away from the plate;

whereby relative rotational movement between the clamping head and tube while the tube and stop means are engaged produces both relative sliding motion longitudinally between the head shank clamping surfaces and the corresponding contact surfaces of the slide blocks, and relative pivotal or rolling motion between the head shank clamping surfaces and corresponding contact surfaces of the slide blocks to engage the tube with the pressure surfaces.

2. A clamping head for use with a tube as set forth in claim 1, further including:

a clamping head housing disposed about the smaller end of the shank having an end limit stop for engaging the end of the thrust members;

the clamping head housing including a carrier means for biasing the clamping piece means opposite the direction of relative circumferential motion it pivots to engage the tube.

3. A clamping head for use with a tube as set forth in claim 2, wherein:

the clamping surfaces have a pitch which is curved at one end of the head shank and which tapers progressively to be substantially straight at the other end of the head shank;

the corresponding contact surfaces on the slide blocks have a pitch which is substantially straight at the end of the slide block positioned over the end of the head shank which is opposite to the curved clamping surfaces, and which pitch tapers progressively to be curved at the other end of the clamping piece means.

4. A clamping head for use with a tube as set forth in claim 1, wherein:

the clamping surfaces have a pitch which is convex at the larger end of the head shank and which progressively tapers gradually to a substantially straight pitch at the smaller end of the head shank;

the contact surface on each corresponding clamping piece means is curved such as to cause the thrust members to move with their pressure surfaces parallel with the longitudinal axis in all expansion and contraction positions.

5. A clamping head for use with a tube as set forth in claim 1, wherein:

the clamping surfaces have a pitch which is straight at the larger end of the head shank and which tapers progressive to a substantially concave pitch at the smaller end of the head shank;

the contact surface on each corresponding clamping piece means is curved such as to cause the thrust members to move with their pressure surfaces parallel with the longitudinal axis in all expansion and contraction positions.

6. A clamping head for use with a tube as set forth in claim 5, further including:

a readjusting device disposed about the free end of the head shank, the readjusting device including an arm pivotally disposed about the head shank, a clamping head housing rotatably mounted about the head shank and engageable with the clamping piece, and a spring mounted between the stop means and arm to bias the clamping head housing in opposed directions circumferentially about the head shank to urge the clamping piece means to an intermediate position when the pressure surfaces are disengaged from the tube.

* * * * *

UNITED STATES PATENT AND TRADEMARK OFFICE

CERTIFICATE OF CORRECTION

PATENT NO. : 5,524,849

DATED : 06/11/96

INVENTOR(S) : Dorfel et al

It is certified that error appears in the above-indentified patent and that said Letters Patent is hereby corrected as shown below:

Column 5, line 11: "13" should read --C--.

Signed and Sealed this

Eighth Day of April, 1997

Bruce Lehman

*Attest:*

BRUCE LEHMAN

*Attesting Officer*

*Commissioner of Patents and Trademarks*